United States Patent [19]

Shackleton

[11] 4,376,357

[45] Mar. 15, 1983

[54] MACHINE TOOLS

[75] Inventor: Raymond T. Shackleton, Keighley, England

[73] Assignee: Keighley Grinders (Machine Tools) Ltd., West Yorkshire, England

[21] Appl. No.: 179,756

[22] Filed: Aug. 20, 1980

[30] Foreign Application Priority Data

May 21, 1980 [GB] United Kingdom ..... 8016766

[51] Int. Cl.[3] ..... B24B 19/14

[52] U.S. Cl. ..... 51/105 SP; 51/5 D; 51/106 R; 51/240 H; 409/191; 409/211

[58] Field of Search ..... 51/5 D, 47, 98.5, 99, 51/101 R, 103 C, 105 SP, 105 R, 106 R, 106 LG, 106 VG, 124 R, 124 L, 125.5, 126, 147, 165.88, 216 A, 217 A, 218 A, 240 A, DIG. 14; 409/191, 200, 201, 211

[56] References Cited

U.S. PATENT DOCUMENTS

| | | | |
|---|---|---|---|
| 2,132,924 | 10/1938 | Belden | 51/240 A |
| 2,410,348 | 10/1946 | Johanson et al. | 51/101 R |
| 2,573,220 | 10/1951 | Riedesel et al. | 51/147 X |
| 2,654,189 | 10/1953 | Dunn et al. | 51/101 R |
| 2,660,838 | 12/1953 | Green | 51/240 A |
| 2,708,816 | 5/1955 | Balsiger | 51/105 SP |
| 2,787,089 | 4/1957 | Hawkinson | 51/106 R X |
| 2,911,764 | 11/1959 | Steggeman | 51/106 R |
| 3,482,357 | 12/1969 | Inaba | 51/101 R X |
| 3,717,961 | 2/1973 | Suzuki | 51/165.88 |
| 4,122,634 | 10/1978 | Nishimura et al. | 51/101 R X |

*Primary Examiner*—Stephen G. Kunin
*Assistant Examiner*—Robert P. Olszewski
*Attorney, Agent, or Firm*—Watson, Cole, Grindle & Watson

[57] ABSTRACT

The invention relates to a grinding machine in which a workpiece such as a multi-stage compressor or turbine rotor to have grinding operations carried out at different locations along the workpiece at different radii and at different angles is mounted between sensors on a slideway to present the locations on the workpiece to be ground to a motor driven grinding wheel mounted in a grinding head. The grinding head is mounted on a slideway to traverse the grinding wheel towards and away from the periphery of the workpiece at a location where the grinding operation is to be carried out and the grinding wheel is mounted on the slide for rotational adjustment about an axis extending tangentially to the periphery of the grinding wheel at a location where the grinding wheel acts on the workpiece for adjustment of the angle of cut of the grinding wheel. Since the grinding wheel turns about the axis when its angle is adjusted, the position of the angle of cut is not otherwise varied by the angular adjustment of the grinding wheel. A control mechanism is provided for enabling the grinding wheel to be accurately pre-set to a number of pre-determined angles to suit the workpiece to be ground. The grinding wheel head includes a dresser unit for dressing the grinding wheel and a mechanism for moving the grinding wheel into engagement with the dresser unit to dress the wheel and restoring the grinding wheel with compensation for the amount of material removed by the dresser unit from the periphery of the grinding wheel to the position in which the axis about which the wheel head turns lies tangentially to the periphery of the grinding wheel.

15 Claims, 8 Drawing Figures

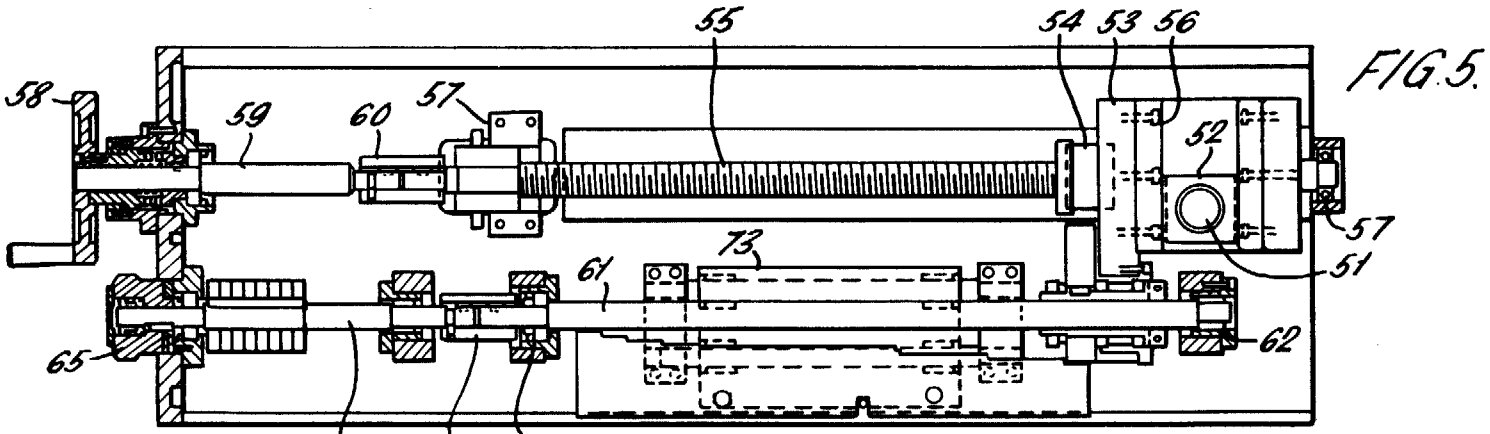
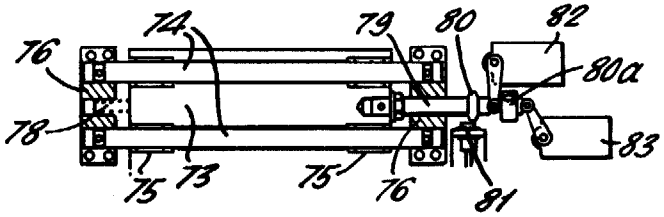
FIG. 6.
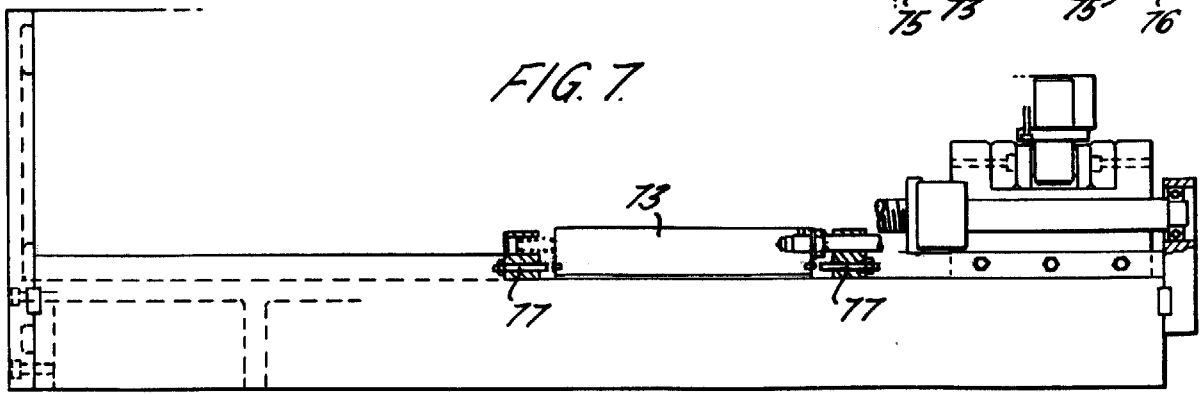
FIG. 7.

MACHINE TOOLS

BACKGROUND OF THE INVENTION

1. Field of the Invention

This invention relates to machine tools and is particularly although not exclusively applicable to grinding machines including grinding machines for grinding the blade tips of multi-stage turbine or compressor rotors.

2. Description of the Prior Art

Machine tools are commonly known in which a workpiece rotates about a fixed axis and a rotary tool having a peripheral cutting face is traversed towards and away from the workpiece surface to carry out a cutting operation on the workpiece surface. In order to adjust the angle of cut with respect to the workpiece axis, the rotary cutting tool has a mounting which permits rotational adjustment of the tool to provide the required angle of cut. Such an arrangement requires considerable setting time in order to set the angle of cut correctly with the location of cut at the correct station on the workpiece since adjusting the angle of cut disturbs other adjustments of the tool.

In the case of blade tip grinding, the radius of the blade tips are given with reference to a longitudinal dimension from a datum. On a normal 'Universal' grinding machine the pivot axis, about which the grinding wheelhead is pivoted for the various angles, is remote from the periphery of the grinding wheel. This necessitates angular adjustment to a much higher accuracy, than that required by the actual component, in order to establish the correction required in both the radial and longitudinal axes for the various angles. In practice this precludes an automatically sequenced machine, as there is no positive method of checking the position of the grinding wheel periphery.

SUMMARY OF THE INVENTION

This invention provides a machine tool having means to support and rotate a workpiece about a fixed axis for an operation to be carried out on a peripheral part of the workpiece, a rotary tool having a peripheral cutting face, a tool carrier on which the tool is mounted, means to feed the tool carrier towards and away from the fixed axis to act on the workpiece, a pivotal mounting for the rotary tool on the tool carrier, the pivotal mounting being adjustable about a further axis lying tangentially to a circle centred on the first axis, and the tool being located on the mounting so that the further axis extends tangentially to the peripheral cutting face of the tool whereby adjustment of the tool about said further axis does not otherwise displace the circumferential cutting face of the tool at the point where it engages the workpiece.

More specifically the invention provides a machine tool having means to support and rotate a workpiece about a fixed horizontal axis for an operation to be carried out on a peripheral part of the workpiece, means for displacing the workpiece longitudinally relatively to an axis transverse to the workpiece axis, means for displacing a vertical axis towards or away from the workpiece axis along the said transverse axis, means for adjusting the grinding wheel mounting to cause the grinding wheel periphery to be tangential to the vertical axis during the life of the grinding wheel, means for dressing the grinding wheel and means for pivoting the grinding wheel mounting to adjust the periphery of the grinding wheel to the required angles.

By this arrangement it is possible to programme the vertical (pivot) axis according to the drawing dimensions of the required workpiece and to adjust the grinding wheel periphery to the required angles with the required accuracy.

BRIEF DESCRIPTION OF THE DRAWINGS

FIGS. 5–7 show further details of the adjusting mechanism; and

DESCRIPTION OF THE PREFERRED EMBODIMENT

Figure 1:
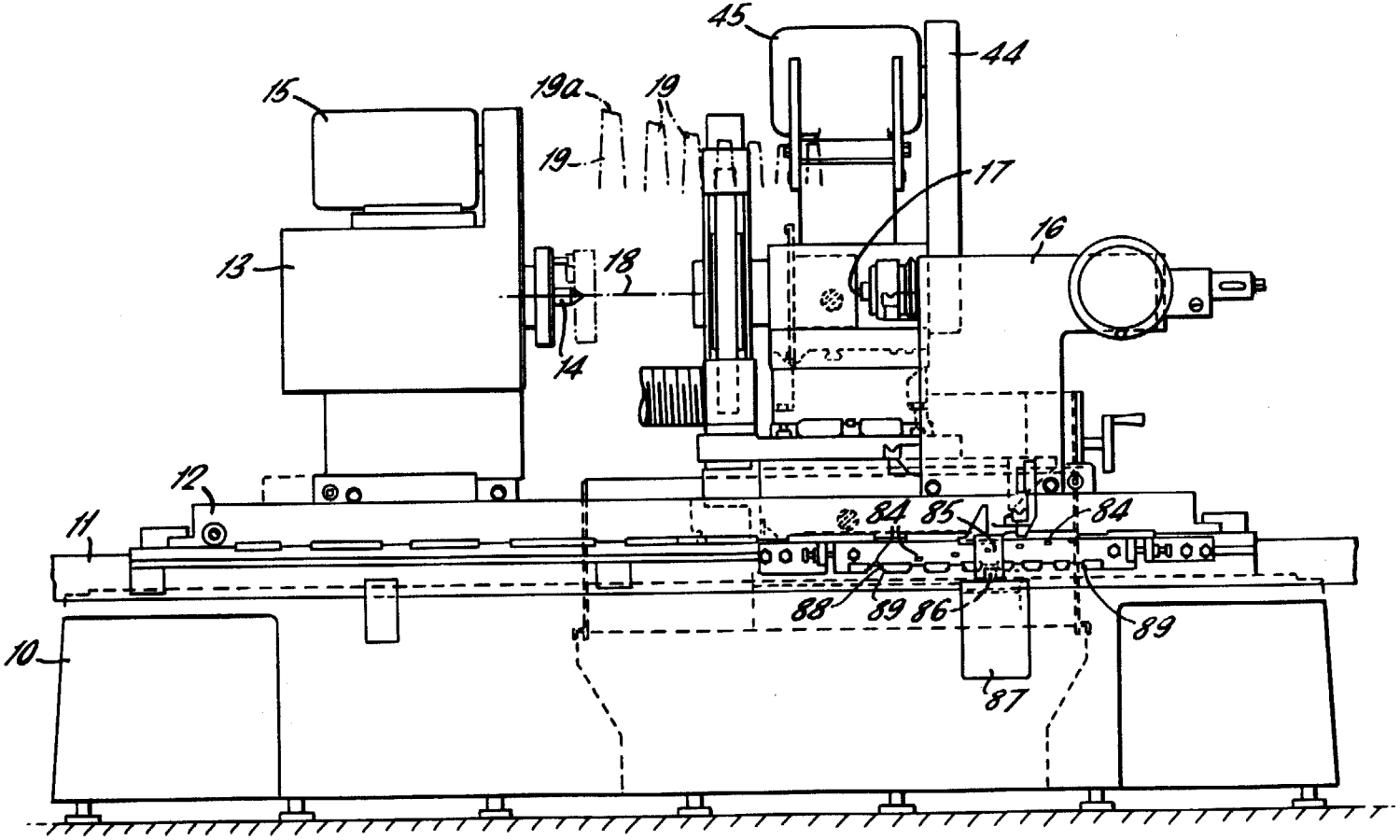
FIG. 1 is a front elevation view of a grinding machine for grinding the blade tips of multi-stage compressor or turbine rotors.

The drawings show a grinding machine for grinding the tip blades of a multi-stage compressor or turbine motor comprising a main base 10 formed with a slideway 11 extending along the length thereof on which a slide 12 is mounted to move. The slide 12 is displaced along the slideway 11 by means of a motor driven lead screw 9 see FIG. 2. A control mechanism for moving the slide by predetermined amounts along the slideway will be described later.

The slide 12 carries a headstock 13 having a center 14 driven by a motor 15 and a tailstock 16 having a center 17. The centers 14, 17 are aligned along an axis indicated at 18. The centres support a multi-stage compressor or turbine rotor to rotate about the axis 18. The drawing illustrates seven rows of turbine blades of such a rotor. It will be seen that the rows of turbine blades reduce in diameter along the axis and that the ends of the turbine blades **19*a*** are differently angled from row to row. The purpose of the present grinding machine is the grinding of the correct blade tip angle to provide the appropriate clearance when the rotor is installed in its casing.

Figure 2:
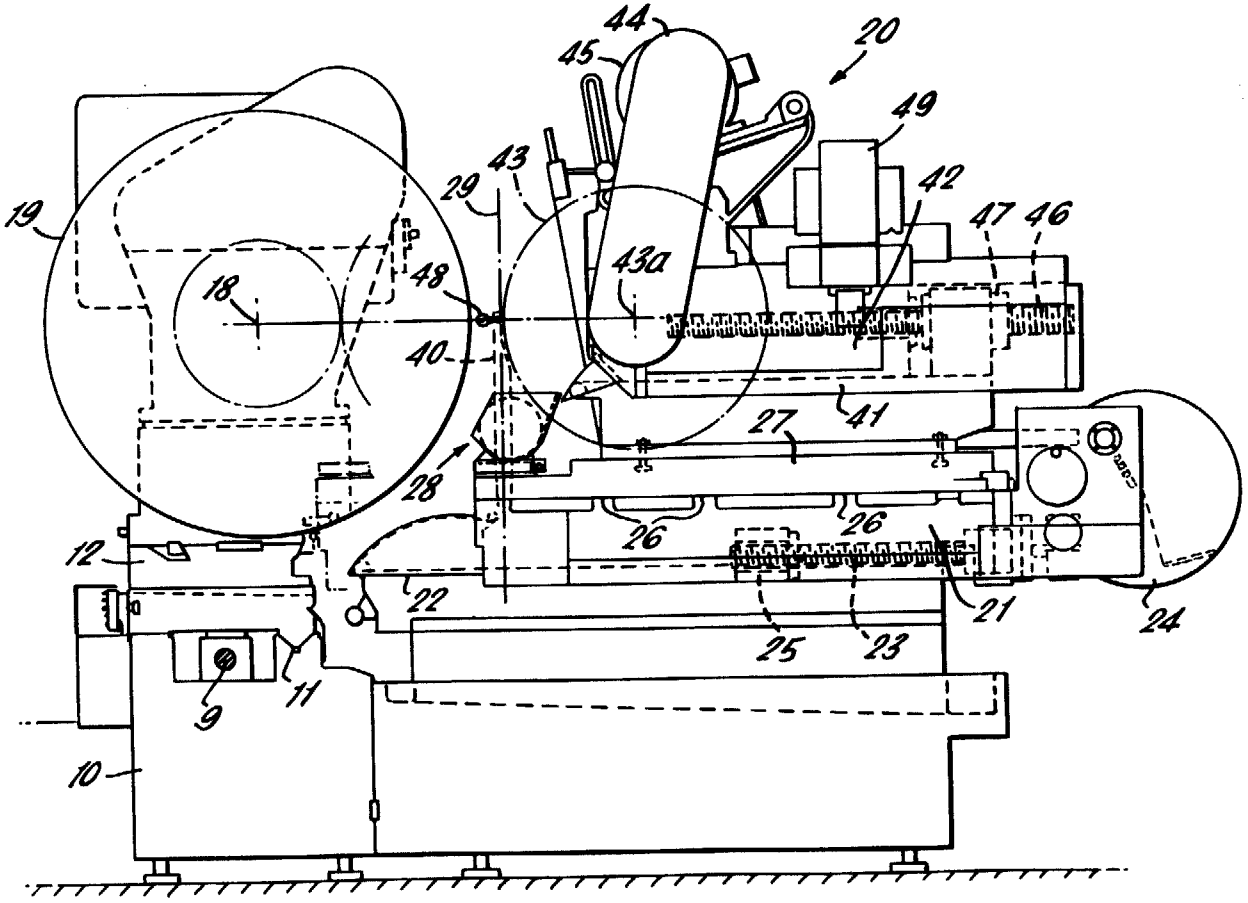
FIG. 2 is an end view of the grinding machine shown in FIG. 1.
Figure 4:
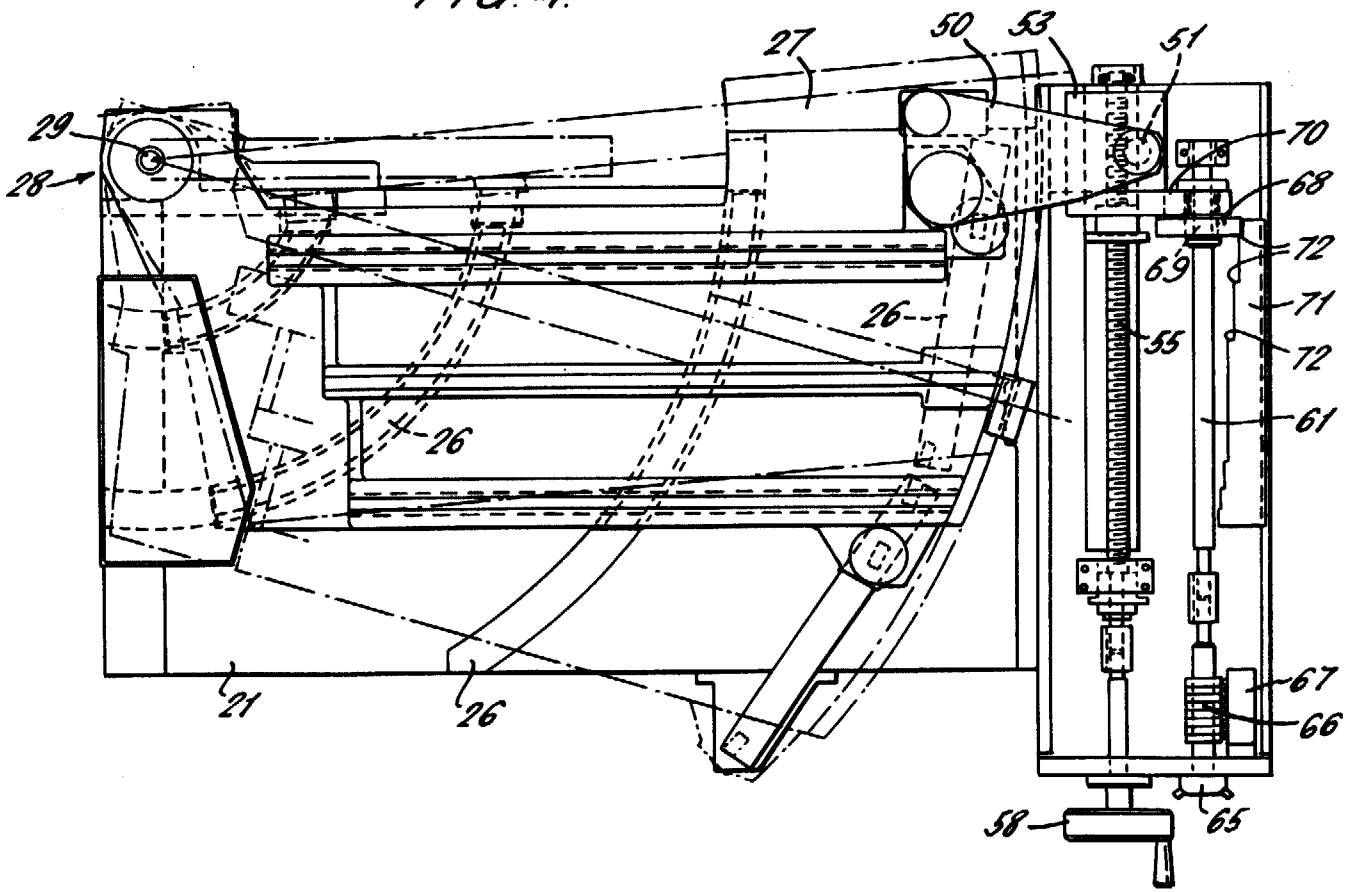
FIG. 4 is a diagrammatic view of part of the grinding head of the machine showing the mechanism for adjusting the angle of the grinding head.

Reference is now made to FIGS. 2 and 4 of the drawings which illustrate the grinding head of the grinding machine used to grind the ends of the turbines blades to the correct diameter and angle.

In FIGS. 2 and 4 of the drawings the grinding head indicated generally at 20 comprises a feed slide 21 mounted on a slideway 22 for movement of the grinding head towards and away from the axis 18 of the workpiece. The grinding head is driven along the slide by a lead screw 23 mounted in the slide and driven through gearing by a stepper motor 24. The lead screw engages in a bore nut 25 mounted on the base 10 adjacent the slideway 22.

The upper face of the slide 21 is formed with a number of spaced arcuate bearing surfaces 26 and a grinding wheel carrier 27 is mounted on the bearing surfaces 26 and a pivotal connection indicated generally at 28 is provided between the carrier 27 and the slide 21 at the ends thereof adjacent the workpiece axis so that the carrier 27 can turn about a vertical axis 29 with respect to the slide. The construction of the pivotal connection 28 is illustrated in greater detail in FIG. 8 to which reference will now be made. The slide 21 is formed with a step bore 30 in which a bearing hub 31 is mounted containing spaced thrust bearing races 32. A hollow spindle 34 is supported in the thrust bearing races and projects upwardly from the upper end of the hub 31 and is formed with a head 35. The head 35 engages in a bore 36 in the grinding wheel carrier 27, the latter being secured to the head by means of a clamping ring 38. The spindle 34 is formed with an upwardly open tapered socket 39 to receive the tapered end of the setting bar 40 the purpose of which will be described later.

Reverting again to FIG. 2 of the drawings, the carrier 27 is formed with an upwardly facing slideway 41 on which a slide 42 is mounted. A grinding wheel 43 is mounted on a spindle (not shown) supported in bearings on the slide 42 and is driven by a drive mechanism indicated at 44 from a drive motor 45. A stepper motor driven lead screw 45 is mounted on the slide 42 and engages in a bore nut 47 mounted on the slideway 41. Rotation of the lead screw thus draws the slide 42 in either direction along the slideway 41 thus moving the grinding wheel 43 towards and away from the axis 18.

Figure 8:
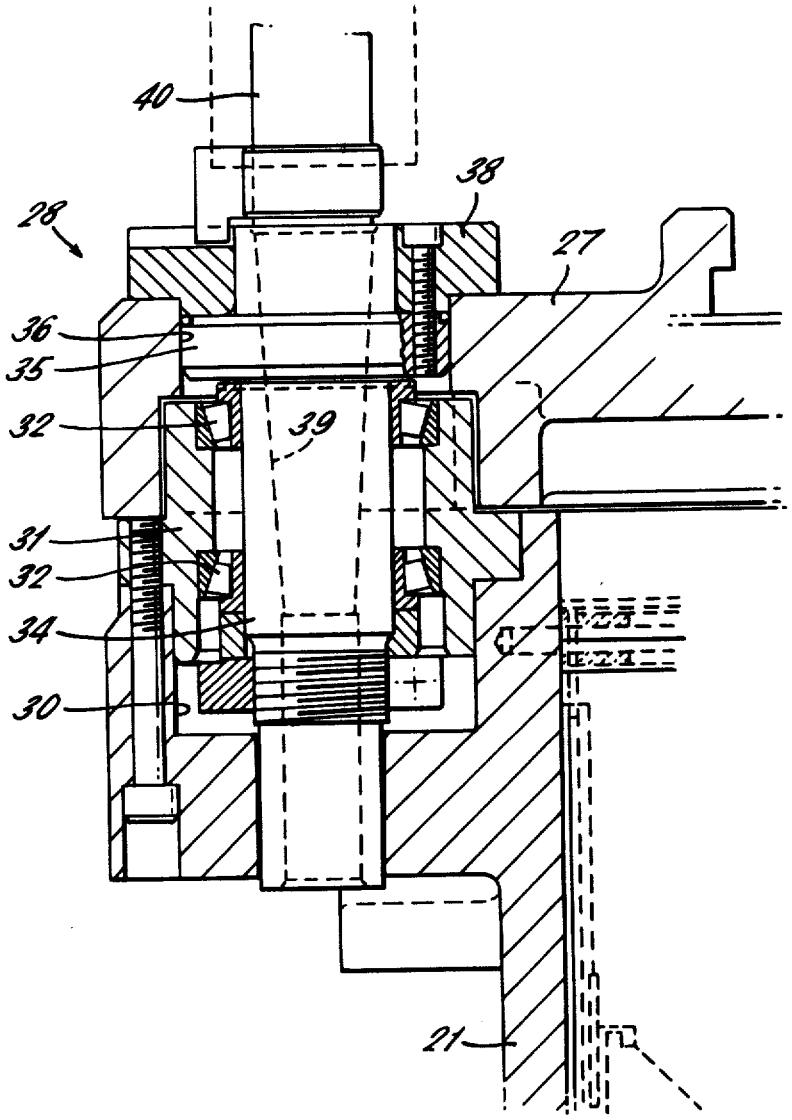
FIG. 8 is a section view through a pivot axis of the grinding head.

As can be seen in FIG. 2 of the drawings, the axis of rotation of the grinding wheel 43 indicated at 43*a* is level with the workpiece axis 18 and the position of the grinding wheel is such that the aforesaid vertical axis 29 extends tangentially to the periphery of the grinding wheel at the point on the grinding wheel nearest the workpiece axis 18 and lying on the horizontal line joining the axes 18 of the workpiece and 43*a* of the grinding wheel. The grinding wheel 43 is set up with its periphery coinciding with the axis 29 as described using the setting bar 40 located in the socket in the spindle 34 as illustrated in FIG. 8. The setting bar 40 carries a horizontally projecting dial gauge 48 at its upper end which acts along the horizontal line joining the axes 18 and 43*a*. The setting bar 40 is located with the probe of the dial gauge engaging the grinding wheel periphery and the grinding wheel is adjusted by means of the lead screw 46 until the gauge reads zero indicating that the vertical axis 29 intercepts the periphery of the grinding wheel 43 tangentially. The setting bar 40 is then extracted from the spindle.

A diamond dresser unit 49 is mounted on the slide 42 for dressing the grinding wheel 43 as and when required during a grinding operation. For this purpose the dresser unit is moved along the slide by a motor driven lead screw (not shown). The unit is advanced by a predetermined increment to bring the diamond tool of the unit 49 into contact with the periphery of the grinding wheel. The grinding wheel is dressed parallel by the dresser and the amount of material removed from the periphery of the grinding wheel is monitored and the lead screw 46 is turned by its drive motor by a corresponding amount to return the grinding wheel to a position in which the vertical axis 29 intercepts the periphery of the grinding wheel vertically as shown in FIG. 2. Thus the removal of the worn grinding wheel surface whenever the grinding wheel is re-dressed is always compensated for so that the axis 29 always extends tangentially to the grinding wheel periphery whenever the grinding wheel is in use.

Figure 3:
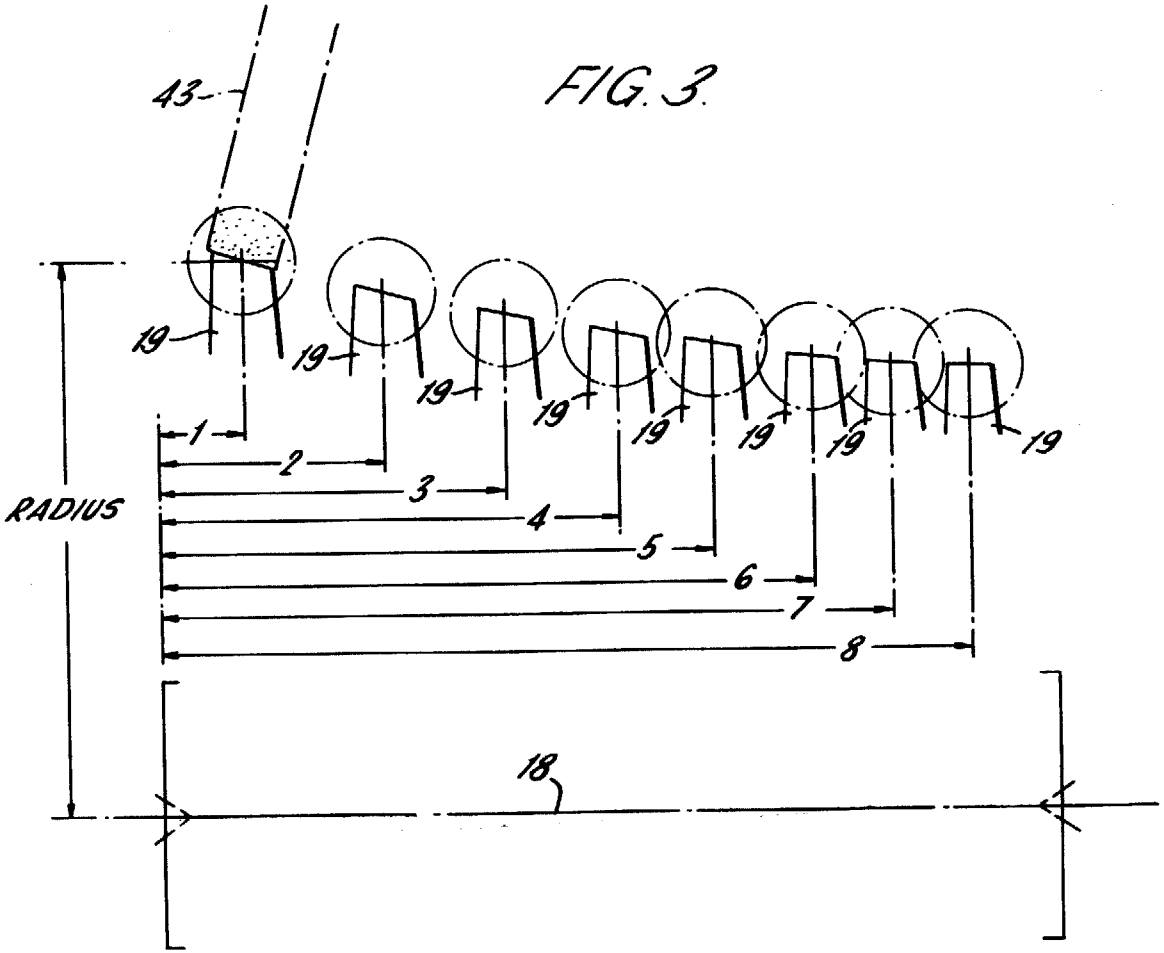
FIG. 3 is a diagrammatic view of the grinding wheel and rotor showing the different tip angles to which the blade tips require to be ground.

As indicated earlier in the description with reference to FIG. 1 of the drawings, the ends 19*a* of the blade tips are angled differently from row to row of blades according to the contour of the casing within which the rotor is to operate. It is therefore necessary to angle the grinding wheel 43 to grind the blade tips to the correct angle with respect to the workpiece axis 18 as indicated in FIG. 3. Adjustment of the angle of operation of the grinding wheel 43 with respect to the workpiece axis 18 is effected by turning the grinding wheel carrier 27 about the axis 29. This adjustment is made for each row of blades 19 using the mechanism which will now be described with reference to FIGS. 4 and 5. As illustrated in FIGS. 4 and 5, the grinding wheel carrier 27 swings about the pivot axis 29 over the surface of the slide 21. At the end of the grinding wheel carrier remote from the pivot axis 29 there is a laterally projecting arm 50 having a pin 51 projecting downwardly from the end thereof and engaging in a bore in a slide block 52 as best seen in FIG. 5. A cross-head 53 is mounted by means of bore nuts 54 on a lead screw 55 and the cross-head 53 has a cross-block 56 in which the block 52 is slideably engaged. The lead screw 55 is rotatably supported in bearing mountings 57 and is turned by a handle wheel 58 through a drive shaft 59 and connector 60. By turning the hand wheel 58, the pin 51 is moved along the lead screw 55 thus turning the grinding wheel carrier 27 through the arm 50 about the pivot axis 29 to adjust the angle of cut of the grinding wheel with respect to the workpiece axis 18 as described earlier.

Parallel to the lead screw 55 there is mounted a further shaft 61 supported in bearings 62 and to which an input shaft 63 is coupled by a sleeve 64. The input shaft has an actuating knob 65 and carries a number of strikers 66 for selectively actuating a bank of micro-switches 67 according to the rotary position set by the selector knob actuating 65. The shaft 61 carries a spider 68 of irregular length legs formed on a hub 69. An arm 70 connects a cross-head 53 to the hub 69 so that the hub 69 moves with the cross-head as the cross-head moves along the lead screw 55.

An elongate control member 71 is mounted adjacent the path of the spider 68 along the shaft 61 and is formed with spaced steps 72 along one edge thereof for engagement by respective legs of the spider 68. The steps define the positions to which the grinding wheel carrier 27 and therefore the grinding wheel itself can be turned about the axis 29. In the position shown in FIG. 4, the first longest leg of the spider 68 is shown engaging a first step 72 on the control member 71. When the grinding operation for that position of the grinding wheel carrier 27 has been completed, the shaft 61 is turned to disengage the first spider leg from the first shoulder 72 and to bring the second, shorter, spider leg into register with the control member 71. The length of the second leg is such that the spider can now move past the first step 72 of the control member but will be intercepted and stopped by the second step 72. The hand wheel 58 is then turned to rotate the grinding wheel carrier 27 as described previously and as the carrier turns, the spider 68 is drawn by the arm 70 until the second leg of the spider engages the second step 72.

The control member 71 is mounted for limited longitudinal floating movement on a base member 73 which is best seen in FIG. 6. Base member 73 is mounted on a pair of parallel guide rods 74 by means of bearings 75. The parallel guide rods 74 are secured at their ends in fixed mounting 76. The movement of the base member 73 along the guide rods is limited by fixed stops 77 best seen in FIG. 7. The base member 73 is biassed in a direction towards the spider 68 by means of a compression spring 78 mounted between one mounting 76 and the adjacent end of the base member 73. The other end of the base member 73 has a projecting probe 79 which extends through the adjacent mounting 76 and is formed with two spaced collars 80, 80a adjacent the end of the probe. The proximity switch 81 is located in the path of the collar 80 to give a signal to a control system for the grinding machine to indicate when the collar has been displaced into register with the probe by displacement of the control member 71 by the spider 68. The steps 72 on the control member 71 are positioned such that when the proximity switch 81 is triggered by the collar 80 by movement of the control member 71 in response to engagement of the spider 68 with a step 72 on the control member, the grinding wheel carrier 27 is in the required rotational position dictated by that step 72 on the control member. The other collar 80a is engaged on either side by operating members of limit switches 82, 83 which are set up to give a signal when the probe 79 and therefore the control member 71 has not yet reached its position for adjustment or has moved beyond the required position of adjustment as dictated by the proximity switch 81.

The proximity switch 81, limit switches 82, 83 and switches 67 controlled by the selector knob 66 are all connected into a pre-programmed micro-processor which has appropriate indicators for showing the machine operator when the grinding wheel carrier is in its correct position, has not yet reached its correct position, or is beyond its correct position so that the hand wheel 58 can be adjusted appropriately.

As indicated earlier in the description, the turbine or compressor rotor to be ground is supported between centers 14 and 17 is traversed along the slideway 11 to present the rows of blades 19 one after the other in succession to the grinding wheel. The drive motor for controlling the lead screw 9 which moves the slide 12 along the slide way is controlled by a number of cams 84 spaced along and also vertically on the slide 12 for operating a stack of limit switches 85. The limit switches control, through the micro-processor referred to earlier a solenoid operated plunger 84, the solenoid being indicated at 87 mounted on the slideway to engage in a plurality of notches 88 spaced apart along the slide to determine the position of adjustment of the slide along the slideway. The mouths of each notch 88 have stepped corners indicated at 89 and if the plunger 86 engages on a step as opposed to going fully home into a notch when it is fired by its solenoid, this is detected and a warning light operated on the indicator system through the micro-processor. The operator can then manually operate the motor for the slide to move the slide forwardly sufficient to allow the plunger to go home fully. Once the plunger goes home fully. A signal is given from the plunger control to the micro-processor and an indicating light is illuminated accordingly.

In addition to the various proximity and limit switches referred to above, there are further switches throughout the apparatus so that the full operation of the machine is interlocked. Thus when a switch is pressed to cause the slide 12 to move to the next position to bring the next set of blades to the working position, the grinding wheel cannot be traversed forwardly to carry out the grinding operation until the micro-processor control system has detected that the slide 12 has moved to the correct position and that the correct new grinding wheel angle has been selected by the selector knob 65 and the grinding wheel carrier has been adjusted to the correct position by the hand wheel 58. The movement of the grinding wheel itself along its slideway 22 is controlled automatically by the micro-processor. Between grinding operations the slide 21 is located in a retracted position. When the slide 12 has been moved to a position and the grinding wheel carrier 21 adjusted to the required new angle, the operator operates a control to initiate the grinding cycle. The slide 21 is traversed rapidly along the slideway 21 to bring the grinding wheel near to the workpiece and then the motor of the lead screw 23 automatically reduces speed to move the grinding wheel forward slowly at the required feed speed for operating on the workpiece. When the grinding wheel is required to be dressed, the operator initiates the dressing sequence. This causes the dresser unit 49 to advance by a pre-set increment and, after the dressing operation has been completed, slide 42 is automatically advanced by its drive motor operated by the micro-processor control system to restore the grinding wheel to the operative position with the axis 29 lying tangentially to the new periphery of the grinding wheel as indicated in FIG. 2. The operator then actuates the motor for the slide 21 to drive the grinding wheel forwardly to continue the grinding operation. In some instances, it is necessary to dress the grinding wheel several times during the grinding of one row of turbine blades according to the material of the blades.

I claim:

1. A machine tool comprising, means to support and rotate a workpiece about a fixed axis for an operation to be carried out on a peripheral portion of the workpiece, a rotary tool having a peripheral cutting face, a tool carrier on which the tool is mounted, means to feed the tool carrier toward and away from the fixed axis for the tool to act on the workpiece, the means comprising a slideway extending transversely to the fixed axis and a slide on which the tool carrier is mounted and drive means for moving the slide in either direction along the slideway, a pivotal mounting for the rotary tool on the tool carrier, the pivotal mounting being adjustable about a further axis lying tangentially to a circle centered on the fixed axis, the slide having, at the end thereof adjacent the fixed axis, a rotary mounting defining the further axis, the slide having a bearing face, the tool carrier being mounted on the bearing face for sliding movement about the rotary mounting, a lead screw rotatably mounted on the slide and carrying a nut to which the carrier is connected so as to turn the tool carrier with respect to the slide about the further axis to adjust the angle of cut of the rotary tool, means for defining the rotational positions of rotational adjustment of the carrier with respect to the slide about said further axis, said defining means comprising a control member extending parallel to the lead screw and having a plurality of stops spaced apart along the member and an adjustable cam mounted to move with the carrier and engageable with one or other of the stops according to the adjustment of the cam to determine the position to which the tool carrier may be moved, the tool being located on the pivotal mounting so that the further axis extends tangentially to the peripheral cutting face of the tool whereby adjustment of the tool about the further axis does not otherwise displace the circumferential cutting face of the tool at the point where it engages the workpiece.

2. A machine tool comprising means to support and rotate a workpiece about a fixed axis for an operation to be carried out on a peripheral part of the workpiece at a work station adjacent the workpiece, slide means for supporting the workpiece support means for movement of the workpiece in the direction of said fixed axis to present different locations along the workpiece for operation thereon at the work station, a rotary tool having a peripheral cutting face, a feed slide for the tool, means to feed the slide towards and away from the fixed axis for the tool to act on the workpiece, a tool carrier, means to mount the rotary tool on the tool carrier for rotation of the peripheral cutting face thereof, means to mount the tool carrier on the feed slide for rotational adjustment about a further axis lying tangential to the circle centered on the fixed axis, means to mount the tool for linear adjustment on the tool carrier towards and away from said further axis for bringing the peripheral cutting face of the tool tangential to said further axis whereby adjustment of the tool about the further axis does not otherwise displace the circumferential cutting face of the tool at a point where it engages the workpiece, means to turn the tool carrier about said further axis comprising a lead screw rotatably mounted on the slide carrying a nut to which the tool carrier is connected, and means for defining a plurality of positions of adjustment for the tool carrier to provide a number of differing angles of operation of the tool on the workpiece comprising a control member extending parallel to the lead screw and having a plurality of stops spaced apart along the member and an adjustable cam mounted to move with the carrier and engageable with one or other of the stops according to the adjustment of the cam to determine the position to which the tool carrier may be moved.

3. A machine tool as claimed in claim 1 or 2 wherein a rotary shaft extends parallel to the lead screw, the cam is fixed to turn with the shaft but is slidable along the shaft, connecting means are provided between the nut and the cam so that the cam moves with the nut along the shaft as the nut moves along the lead screw and means are provided for adjusting the rotational position of the shaft to adjust the cam and thereby determine the stop on the control member to which the cam may be moved thus setting the angle of the tool carrier.

4. A machine tool as claimed in claim 1 or 2 wherein the cam comprises a multi-leg spider, the legs being of different lengths to engage the respective different stops on the control member.

5. A machine tool as claimed in claim 1 or 2, wherein the control member is mounted for limited sliding movement with the cam when the cam engages the appropriate stop on the control member, spring means are provided for opposing the movement and means are provided for indicating when the control member has reached a datum position corresponding to the required position of adjustment of the tool carrier.

6. A grinding machine as claimed in claim 5 wherein the means for indicating when the control member has reached the datum position comprise a proximity switch actuated by an element moving with the control member and means are also provided for indicating when the control member has not reached or has over-run the datum position.

7. A grinding machine as claimed in claim 6 wherein the means for indicating whether the control member has under-run or over-run the datum position comprise limit switches operable by the control member.

8. A grinding machine as claimed in claim 3 wherein switch means are provided associated with the shaft which are operated in accordance with the rotational position of the cam selected for input to a control system for controlling the overall operation of the machine tool.

9. A machine tool as claimed in claim 1 or 2 wherein the rotary tool comprises a grinding wheel.

10. A machine tool as claimed in claim 9 wherein dressing means are provided on the tool carrier for dressing the grinding wheel, means are provided for advancing the dressing means towards the grinding wheel to act thereon and means are provided for repositioning the grinding wheel in the operative position with its periphery intersecting the further axis tangentially.

11. A machine tool as claimed in claim 1 wherein the means and rotate the workpiece about said fixed axis comprises a slide having workpiece supports and means to rotate the workpiece about the fixed axis defined by the support, a slideway extending parallel to the fixed axis and means to move the slide to different stations along the slideway to present different locations on the workpiece to the grinding wheel for operation thereon.

12. A machine tool as claimed in claim 2 wherein the slide means comprises a slide in a slideway extending parallel to the fixed axis, and means to move the slide to different stations along the slideway.

13. A machine tool as claimed in claim 11 or 12 wherein the means for moving the slide carrying the workpiece supports to their different stations comprises a motor driven lead screw.

14. A machine tool as claimed in claim 11 wherein stop means are provided on the slideway for engaging the slide to lock the slide in each of said different stations and means are provided on the slideway for detecting when the slide has reached each of said positions to operate the locking means.

15. A machine tool as claimed in claim 1 or 2 having a control system for controlling operation of a number of the functions of the machine tool and having means to detect the operation of each of the functions, the control system being arranged so that the functions are carried out in accordance with a predetermined sequence.

* * * * *